US006053383A

United States Patent [19]

Gunderson

[11] Patent Number: 6,053,383

[45] Date of Patent: Apr. 25, 2000

[54] LIFTING AID APPARATUS

[75] Inventor: James Gunderson, Littleton, Colo.

[73] Assignee: Stock-Eze Corporation, Littleton, Colo.

[21] Appl. No.: 09/071,347

[22] Filed: May 1, 1998

Related U.S. Application Data

[60] Provisional application No. 60/046,457, May 14, 1997, and provisional application No. 60/060,555, Sep. 30, 1997.

[51] Int. Cl.[7] ..... A45F 5/00

[52] U.S. Cl. ..... 224/270; 224/664; 224/666; 108/43; 248/292.13

[58] Field of Search ..... 224/191, 197, 224/199, 660, 663, 664, 666, 678, 679, 680, 269, 270, 271, 272, 901.8; 108/43; 248/444, 292.13

[56] References Cited

U.S. PATENT DOCUMENTS

| | | | |
|---|---|---|---|
| 733,478 | 7/1903 | Halladay | 224/664 |
| 947,024 | 1/1910 | Paine et al. | 224/270 |
| 984,402 | 2/1911 | Tuttle | 224/270 X |
| 1,128,614 | 2/1915 | Landemare et al. | 248/292.13 X |
| 1,542,163 | 6/1925 | Morde . | |
| 3,009,613 | 11/1961 | Noland . | |
| 3,090,330 | 5/1963 | Best . | |
| 3,125,825 | 3/1964 | Gaudette . | |
| 3,166,080 | 1/1965 | Neale | 220/830 X |
| 3,541,976 | 11/1970 | Rozas . | |
| 3,854,639 | 12/1974 | Genchi | 224/666 X |
| 4,715,293 | 12/1987 | Cobbs . | |
| 5,074,222 | 12/1991 | Welch . | |
| 5,186,375 | 2/1993 | Plonk . | |
| 5,221,031 | 6/1993 | Prigmore | 224/901.8 X |
| 5,221,032 | 6/1993 | Bott et al. . | |
| 5,285,940 | 2/1994 | Goulter . | |
| 5,421,499 | 6/1995 | Bauer . | |
| 5,456,394 | 10/1995 | Israel . | |
| 5,505,356 | 4/1996 | Noriega et al. | 224/901.8 X |
| 5,511,703 | 4/1996 | Ryerson | 224/664 X |
| 5,551,615 | 9/1996 | McIntosh . | |

FOREIGN PATENT DOCUMENTS

| | | | |
|---|---|---|---|
| 81693 | 4/1953 | Norway | 248/444 |
| 10111 | 4/1890 | United Kingdom | 224/270 |

*Primary Examiner*—Gregory M. Vidovich
*Attorney, Agent, or Firm*—Dickinson Wright PLLC

[57] ABSTRACT

A lifting aid apparatus permits easy stocking of shelves while in use and unimpeded movement by an individual wearing the lifting aid apparatus while not being used. The apparatus includes a support table which moves between an inoperative or closed position and an operative or horizontal position using a biased hinge. With the bias positioning the table in a somewhat vertical position, the table is out of the way when an individual is moving about while donning the apparatus. The table can be pivoted downwardly so that it is generally horizontal and be used to support at least a portion of a container so that contents of the container can be readily accessed by the individual. The individual can position the support table with respect to an adjacent shelf so that another portion of the container can be supported by the shelf wherein the container rests on both the support table and the shelf for easy container emptying, particularly for restocking shelves. The biased hinge can be spring loaded and adjustable in tension to accommodate differently sized containers.

21 Claims, 2 Drawing Sheets

LIFTING AID APPARATUS

This application claims the benefit of provisional application Ser. Nos. 60/046,457 filed May 14, 1997 and 60/060,555, filed Sep. 30, 1997.

FIELD OF THE INVENTION

The present invention is directed to a lifting aid apparatus and, in particular, to an apparatus which facilitates the stocking of shelves in a business establishment.

BACKGROUND ART

Currently, in many business establishments, shelves are restocked manually. More particularly, a stocker will lift a box having items to be stocked on a particular shelf. Often times, the stocker will position the box with the items to be stocked with one box edge on the shelf lip and an opposing box side pressed against the stockers torso. Many times, if the stocker moves or changes positions, the box can slip away from the torso and fall to the ground.

In light of this problem, a need has developed to provide an improved method of stocking shelves in a retail establishment such as a supermarket, drug store or the like. The present invention solves this need by providing a lifting aid apparatus which facilitates supporting the end of the box opposite that resting on the shelf lip. With the inventive lifting aid apparatus, the stocker does not have to worry about moving or changing positions since the box containing the items to be shelved is adequately supported by the inventive lifting aid device.

SUMMARY OF THE INVENTION

According, it is a first object of the invention to provide an improved lifting aid apparatus.

A further object of the invention is to provide a lifting aid which facilitates stocking shelves with items from a box.

A yet another further object of the invention is a lifting aid apparatus which includes a pivotal lifting aid table which has an inoperative position so as not to interfere with the activities of a user when not stocking shelves or the like.

A still further object of the present invention is to provide a lifting aid apparatus which combines a spring-loaded hinge mechanism with a lifting table to provide additional weight supporting capacity, particularly for heavier weight items.

Other objects and advantages of the present invention will become apparent as a description proceeds.

In satisfaction of the foregoing objects and advantages, the inventive lifting aid apparatus comprises a belt or other type device which can be secured to the body or torso of a user and a lifting aid support portion. The lifting aid support portion may be attached to the belt in any conventional fashion, e.g. rivets, fasteners, or the like or can be an integral part thereof. The lifting aid support portion supports a lifting aid or table. The table is pivotally mounted to the support portion so as to be moveable between an inoperative position and an operative position. The inoperative position positions the table close to the user's body so that it does not interfere with a user's movements The operative position has the table in a generally horizontal orientation so that a box or the like can be set thereon and items from the box can be removed using both hands of the user.

The pivotal mounting can be any type which will permit the table to move between the two positions describe above. The term "hinge" as used herein is intended to represent such pivoting devices. A preferred type is a spring loaded hinge which is biased to position the table close to the user when not in use. These types of hinges also provide additional load support by the presence of the spring. For example, a spring loaded door hinge can support up to 70 lbs. The hinge can be mounted in any manner to the support portion. For example, the hinge could be riveted, fastened, clipped to the top edge, bolted or the like to the support portion. In addition, the hinge can be located centrally, along the top edge, or wherever may be suitable depending on the configuration of the support portion and the type of pivotal device is used.

The materials of the lifting aid support can also vary depending on the configuration and selection of the belt, the support portion, the pivoting device and the table. The belt could be leather, elastic or the like, and include an adjustable length feature, clip ends or other known or contemplated features. Similarly, the support portion could be leather or any other material having sufficient strength/durability to support the pivoting device, table and container or box to be lifted and supported. The table can also vary in terms of its material of construction, e.g. a plastic such as ABS, PVC, or the like, or other durable material.

The table can include one or more stops which are positioned on the table to engage a surface of the support portion so as to keep the table in a generally horizontal orientation when in the operative position. Of course, the stops could also be located on the support portion, if so desired.

The invention also includes a method of supporting containers, particularly, those whose contents can be removed and placed on a shelf or the like. In the inventive method, the table can support at least a portion of a container so that the container can be moved to a desired location, either for the purpose of movement alone or to remove the container's contents and place them in a particular location.

The apparatus can also employ a table extension which is attachable to the pivoting table. The attachment can be any type and the extension can have a flat upper surface or include a well or other recess to retain individual items and/or one or more containers. The table extension can be modified to interface with shelves that may have vertical partitions, whereby the table extension may have a slotted free end to permit it to rest on the vertical partition-containing shelf or other configuration. In this embodiment, the table supports the table extension as the item rather than a container holding items. The table extension can then support one or more items as individual items or a plurality of containers. The table extension can be sized so that it is solely supported by the table or, alternatively, one end of the extension can rest on a surface of a shelf or the like with the other end supported by the table.

A tubular stop could be used when a hinge is employed for pivoting movement of the table. The tubular stop would have a cutout portion that would permit one of the hinge plates to travel a set distance between inoperative and operative positions. The tubular stop is sized to slide over the connection between the hinge plates and be secured in any fashion.

BRIEF DESCRIPTION OF THE DRAWINGS

Reference is now made to the drawings of the invention wherein.

DESCRIPTION OF THE PREFERRED EMBODIMENTS

Figure 1:
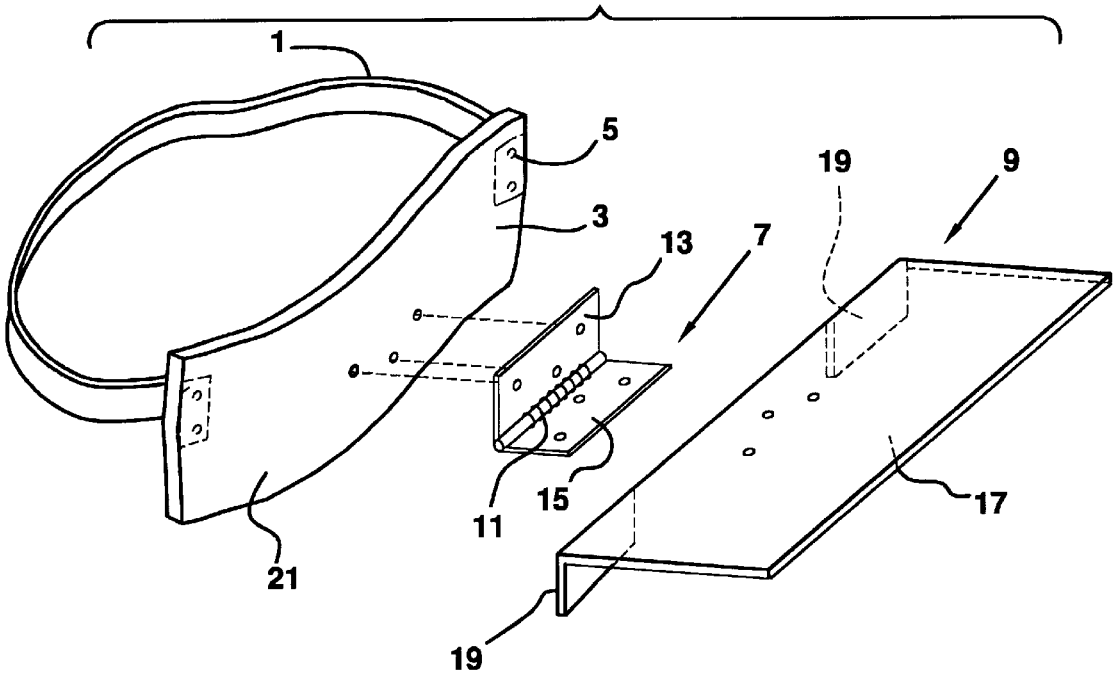
FIG. 1 is an exploded perspective view of one embodiment of the inventive lifting aid apparatus.

An exemplary lifting aid apparatus is generally is designated by the reference numeral 10 in FIG. 1 and includes a belt 1 and a lifting aid support portion 3. The belt 1 is shown as a continuous loop and is attached to the support portion 3 using the fasteners 5. Other types of belts and holsters or the like can be used. The purpose of the belt is to surround a user's torso so that the lifting aid apparatus is in the proper position when being used.

The lifting aid apparatus 10 also includes a pivoting device depicted as a hinge 7 and a table 9. The hinge 7 is a spring-loaded type having a biasing spring 11 as a part thereof. Plate 13 of the hinge 7 can be attached to the support portion 3 by using fasteners or rivets (not shown).

The plate 15 of the hinge 7 is then attached to the underside 17 of the table 9 by fasteners or the like.

The table 9 is sized in width and length to provide an adequate supporting surface when the lifting aid apparatus is used to support a container or box for shelf stacked. For example, the table may be 5"×8" long and 8" wide. Other dimensions can be used if so desired.

The table 9 of FIG. 1 is shown with a pair of stops 19. The stops 19 are designed to mate with the surface 21 of the support portion 3 so that the table 9, when in the operative position, is generally horizontal for container or box support.

Figure 2:
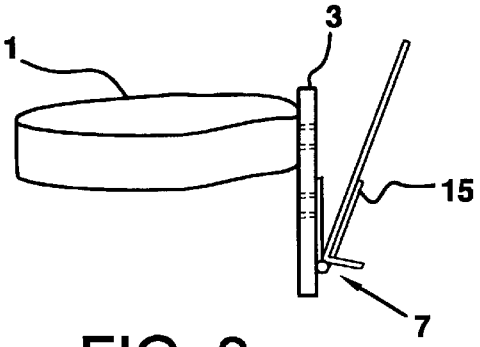
FIG. 2 is a side view of the apparatus of FIG. 1 in an inoperative position.
Figure 3:
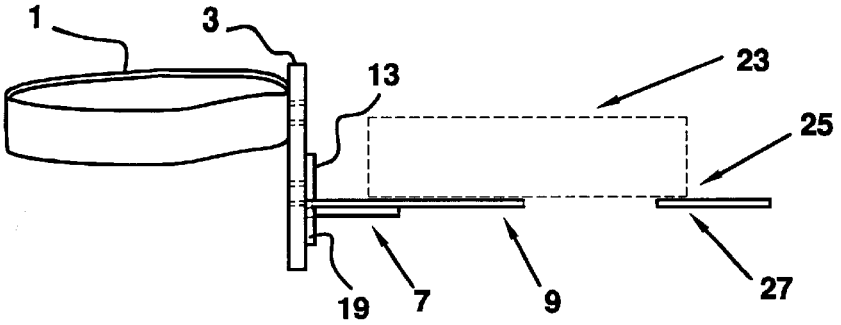
FIG. 3 is a side view of the apparatus of FIG. 1 in an operative position.

With reference now to FIGS. 2 and 3, the operative and inoperative positions of the inventive lifting aid apparatus are depicted. In FIG. 2, the table 9 is shown spring-biased toward the support portion 3 so that it is out of the way when a user is moving about.

In FIG. 3, the table is shown in the operative position so that it can support a container 23 when the container edge 25 is placed on a shelf edge 27. The table 9 can be pivoted to the operative position shown in FIG. 3 either by a user's hand or by resting a container on the table's distal edge. With the container on both the shelf edge 27 and the table 9, a user can then empty the container using both hands without fear of having the container 23 fall to the floor and spill its contents. After the container 23 is emptied, it can be lifted off the shelf edge 27 and table 9. With this lifting action, the table 9, by reason of the bias of the spring 11, reverts to the inoperative position shown in FIG. 2. It should be understood that the use of a spring bias to position the table between operative and inoperative positions is a preferred embodiment of the invention. Other types of pivoting devices could also be used as are known or contemplated in the art.

While the lifting aid apparatus is disclosed for particular use for stocking shelves, it could also be used to transport items from one location to another. In this mode, a user could merely steady the item to be transported while it rests on the table 9 until reaching the desired location.

Figure 4:
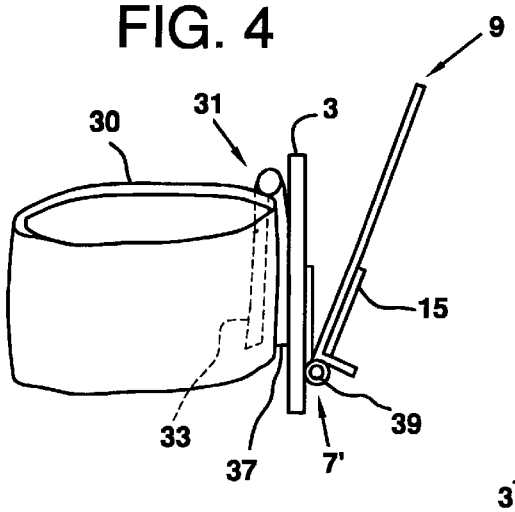
FIG. 4 shows an alternative attachment of the inventive device to a belt.

FIG. 4 shows another embodiment wherein a support portion 3' is utilized to permit attachment to a conventional belt or like. In contrast to support portion 3 which was linked to the belt 1 by fasteners 5, support portion 3' employs one or more clips 31 (three preferred) to facilitate attachment to a belt worn by a user which may serve another purpose, e.g. a safety belt used for heavy lifting. The clip 31 is spring loaded to clamp to the belt 30 which is positioned between the clip legs 33 and 37. In this way, the lifting device can be used with the support portion 3' and without the need for the belt 1. Of course, the clip attachment is exemplary and other types of attachments which will permit fastening the support portion 3' to a belt or other type of wearing apparel are within the scope of the invention.

FIG. 4 also illustrates a hinge 7' which is adjustable in tension via the hex or allen wrench end 39. Tension is adjusted by inserting a tool end adapted in size to mate with the end 39 and rotating the tool end in the desired direction. These hinges are conventional and a further description thereof is not necessary for understanding of the invention. With a hinge of this sort, a user can adjust the tension of the hinge depending on the loads being supported by the table 9. Higher loads would receive an adjustment to create a higher tension with lower loads allowing for adjustment in the reverse direction.

Figure 5:
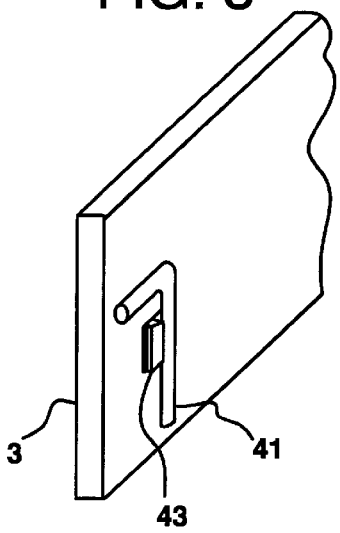
FIG. 5 shows another embodiment of the inventive device with an adjustment tool.

To facilitate adjustment, a wrench, depicted in FIG. 5 as reference numeral 41, can be attached to the portion of the support portion 3 via hook and loop fastening means 43. With the wrench 41 attached to the support portion 3, a user of the inventive device can readily access the wrench for tension adjustment as described above. Of course, other types of fastening means can be employed to keep the wrench with the support portion 3. The wrench can also be attached to the belts 1 or 30 or the support portion 3'.

Figure 6:
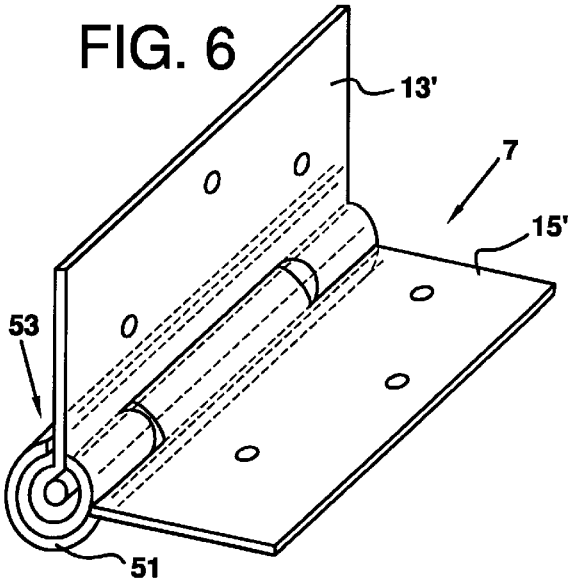
FIG. 6 shows a perspective view of the hinge with an alternative stop arrangement.
Figure 6A:
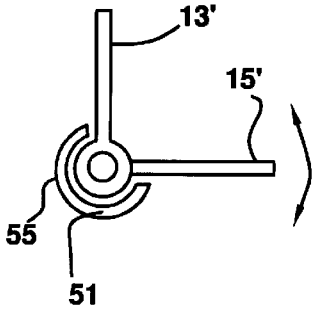
FIG. 6A shows a side view of the FIG. 6 embodiment.

FIG. 6 shows an alternative stop arrangement whereby a tubular member 51 having a 45° cutout 53 along its circumference is positioned over the portions of the plates 13' and 15' forming the pivoting hinge connection identified as reference numeral 55. The movable hinge plate 15' is permitted to pivot within the cutout 53 formed in the tubular member 51, the cutout 53 controlling the range of pivoting motion. Thus, at rest, the table 9 and plate 15 are angled upwardly or generally vertically with respect to a floor surface and generally horizontal when in the operative position, see FIG. 6A. In this embodiment the stops 19 can be used, if desired.

Figure 7:
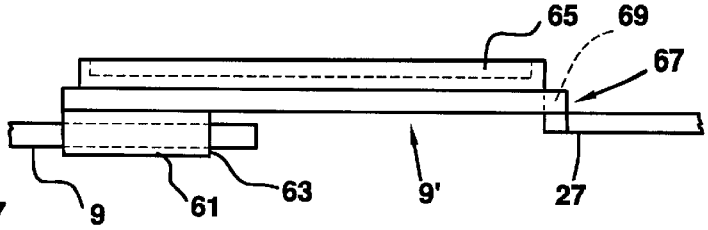
FIG. 7 shows an alternative table arrangement.

FIG. 7 shows an alternative embodiment which is especially adapted for situations where the space between a shelf and where an individual can stand is such that container when resting on the table 9 cannot reach the shelf 27. In this embodiment, a table extension 9' slips over the table 9, the table extension 9' configured to reach the shelf 27. Table extension 9' has a lower portion 61 which includes a through slot 63. The slot 63 is sized to receive the distal end of the table 9 so that the table extension 9' is secured thereto. One or more fasteners could also be used to secure the extension 9'0 to the table 9 or a press fit could be used. Other modes of attachment could also be used as would be within the skill of the art. The table extension 9' could also have a well 65 which could hold individual items such as video tapes for stocking, the well formed by wall 71 extending from a base 73.

The table extension distal edge 67 could also be segmented to interface with segmented vertical partitions of shelves such as post office boxes. More particularly, the edge 67 could have a series of slots shown as 69 which would receive the upstanding partitions between the post office boxes and permit the edge 67 to rest on the bases of the post office boxes, see FIG. 8.

Figure 8:
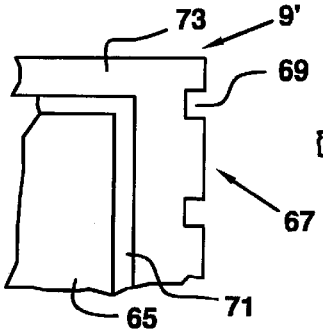
FIG. 8 shows a top view of a portion of an alternative table extension for interfacing with segmented shelves and holding individual items.

FIG. 8 also shows the well 65 surrounded by walls 71. The walls 71 can be positioned along the edges of the table extension base 73 or be spaced inwardly therefrom as shown in FIG. 8, depending on the items to be held. When using an extension table, the lifting aid apparatus can hold individual items rather than a single container that itself holds individual items. Alternatively, the extension can hold multiple containers.

Accordingly, an invention has been disclosed in terms of preferred embodiments thereof which fulfill each and every one of the objects of the present invention as set forth above and provides a new and improved lifting aid apparatus and method of use.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A lifting aid apparatus comprising:

a) a belt having upper and lower edges; and b) a lifting aid device secured to the belt, the lifting aid device further comprising:

i) a support table; and ii) a biased hinge, the biased hinge comprising a first hinge plate and a second hinge plate, the first hinge plate secured to the belt below the upper edge, the support table being secured to the second hinge plate, the bias positioning the hinge in an inoperative position to space a peripheral edge portion of the support table from the belt for downward movement, the support table being pivotal to a generally horizontal position against the bias for supporting an item on the table wherein, in the inoperative position, the first hinge plate faces the second hinge plate.

2. The lifting aid apparatus of claim 1, said belt comprising a substrate supporting the hinge.

3. The lifting aid apparatus of claim 2, wherein the apparatus has at least one stop to control travel of the table.

4. The lifting aid apparatus of claim 3, wherein the table has a pair of stops extending from the table and the hinge is positioned between the pair of stops when secured to the table.

5. The lifting aid apparatus of claim 1, wherein the hinge is a spring loaded hinge.

6. The lifting aid apparatus of claim 5, wherein the spring loaded hinge is adjustable in tension.

7. The lifting aid apparatus of claim 6, wherein the lifting aid device includes a tool for adjusting the tension of the spring loaded hinge and a tool support for retaining the tool in close proximity to the spring loaded hinge.

8. The lifting aid apparatus of claim 7, wherein the tool support is hook and loop fasteners.

9. The lifting aid apparatus of claim 2, wherein the substrate is made of a flexible material and is riveted to a remaining portion of the belt.

10. The lifting aid apparatus of claim 1, wherein the belt is sized to surround an individual's waist.

11. The lifting aid apparatus of claim 3, wherein the at least one stop further comprises an annular member having a cutout portion and being mounted on the biased hinge, the cutout portion defining a travel path for one hinge plate.

12. The apparatus of claim 1, wherein the item is a table extension attachable to the support table.

13. A lifting aid apparatus comprising:

a) a belt sized to be secured to an individual, the belt including a flexible substrate, the substrate having upper and lower edges; and b) a lifting aid device further comprising a spring loaded hinge, the spring loaded hinge comprising a first hinge plate and a second hinge plate, the first hinge plate secured to the substrate, a support table being secured to the second hinge plate, spring bias positioning the support table in a generally upright and inoperative position and spacing a peripheral edge portion of the support table from the belt for downward movement, the support table being pivotal to a generally horizontal operative position against the spring bias for supporting an item on the table, travel of the pivoting movement of the support table controlled by at least one stop wherein, in the inoperative position, the first hinge plate faces the second hinge plate.

14. The lifting aid apparatus of claim 13, wherein the substrate is attached to the belt using one of fasteners and at least one clip.

15. The lifting aid apparatus of claim 13, wherein the spring loaded hinge is adjustable in tension.

16. The lifting aid apparatus of claim 13, wherein the substrate is made of a flexible material and is clipped to the belt.

17. A method of supporting an item comprising the steps of:

a) securing a lifting aid apparatus to an individual, the lifting aid apparatus comprising:

i) a belt having upper and lower edges; and ii) a lifting aid device secured to the belt, the lifting aid device further comprising a support table and a biased hinge, the biased hinge comprising a first hinge plate and a second hinge plate, the first hinge plate secured to the belt below the upper edge, the support table being secured to the second hinge plate, the bias positioning the hinge in an inoperative position; and b) pivoting the biased hinge downward and against the bias to position the table in a generally horizontal position and placing a portion of the item on a portion of the table for supporting the item wherein, in the inoperative position, the first hinge plate faces the second hinge plate.

18. The method of claim 17, further comprising placing another portion of the item on a shelf adjacent an individual so that the item of a portion thereof can be placed on the shelf.

19. The method of claim 17, wherein the biased hinge is a spring loaded hinge which is adjustable in tension to accommodate differently sized items.

20. The method of claim 17, wherein the pivoting motion of the table is controlled by at least one stop.

21. The method of claim 17, wherein the item is a table extension.

* * * * *